US005769497A

United States Patent [19]

Tsai

[11] Patent Number: 5,769,497

[45] Date of Patent: Jun. 23, 1998

[54] ARM SUPPORT STRUCTURE

[75] Inventor: Ching-Tao Tsai, Taipei, Taiwan

[73] Assignee: Fusco Industrial Corporation, Taipei, Taiwan

[21] Appl. No.: 825,996

[22] Filed: Apr. 4, 1997

[51] Int. Cl.[6] ..... A47C 7/54

[52] U.S. Cl. ..... 297/411.36

[58] Field of Search ..... 297/411.2, 411.35, 297/411.36, 411.37, 411.24, 411.27, 463.1, 463.2, 217.2; 248/118, 118.3; 40/320

[56] References Cited

U.S. PATENT DOCUMENTS

| | | | |
|---|---|---|---|
| 4,159,148 | 6/1979 | Schulz | 297/411.37 X |
| 4,763,952 | 8/1988 | Gaudreau, Jr. | 297/411.36 X |
| 5,324,096 | 6/1994 | Schultz | 297/411.36 |
| 5,346,284 | 9/1994 | Dauphin | 297/411.36 |
| 5,435,626 | 7/1995 | Lai | 297/411.36 |
| 5,586,811 | 12/1996 | Tornero | 297/411.36 |

FOREIGN PATENT DOCUMENTS

| | | | |
|---|---|---|---|
| 166870 | 1/1986 | European Pat. Off. | 297/411.36 |

*Primary Examiner*—Milton Nelson, Jr.

*Attorney, Agent, or Firm*—Browdy and Neimark

[57] ABSTRACT

An arm support of a chair which is adjustable to set a height of the armrest and a distance between the armrests includes a support pole, a jacket, a fixed jacket and two toothed members. Each toothed member is provided with teeth along one side thereof. The support pole which is L-shaped has a vertical part and a horizontal part which are formed respectively with an oblong orifice. The jacket has an interior spacing for receiving the vertical part of the support pole. The first toothed member is fixed inside the oblong orifice of the vertical part of the support pole. The jacket is engaged with an elastic button. When a user wants to adjust the arm support to set the height of the armrest, the user may press the elastic button to raise or lower down the jacket with respect to the support pole so as to adjust the height of the armrest. The fixed jacket is fixed on the chair and has an interior spacing for receiving the horizontal part of the support pole. The second toothed member is fixed inside the oblong orifice of the horizontal part of the support pole. The fixed jacket is engaged with an expanded end member. When a user wants to adjust the arm support to set the distance between the armrests, the user may rotate the expanded end member to adjust the position of the support pole relative to the chair and thus the distance between the armrests.

2 Claims, 8 Drawing Sheets

ARM SUPPORT STRUCTURE

FIELD OF THE INVENTION

The present invention relates to an arm support of a chair and in particular to an arm support which is adjustable to set the height of the chair armrests and the distance between the chair armrests.

BACKGROUND OF THE INVENTION

There are chairs available in the market and the armrests of these chairs are conventionally inadjustable. For larger people, the distance between the chair armrests may not be sufficient and this makes them uncomfortable. On the other hand, for smaller people the distance between the chair armrests may sometimes be too large to make them uncomfortable.

Further, when a person uses a computer or typewriter, he/she will keep his/her forearms horizontal so as to avoid to harming muscles in the arm. However due to the fact that the height of the chair armrest is not always suitable to everyone, most people using the computer or typewriter may sometimes harm a muscle.

Thus, an arm support which is adjustable to set the height of the armrest and the distance between the armrests is desired to solve the above problems.

SUMMARY OF THE INVENTION

The principal object of the present invention is to provide an arm support which is adjustable to set the height of the chair armrests and the distance between the chair armrests to suit everyone and to avoid damage to a user's muscle.

Another object of the present invention is to provide an adjustable arm support which incorporates an indicator to show the height of the armrest of the chair with digits to allow a user to adjust the chair armrests to the most desired height.

A further object of the present invention is to provide an arm support which is movable so as to make the distance between the chair armrests adjustable in order to fit for different six people.

In accordance with the present invention, there is provided an arm support which is adjustable to set the height of the chair armrest and the distance between the chair armrests structure comprising a support pole, a jacket, a fixed jacket and two toothed members. The support pole which is L-shaped has a vertical part and a horizontal part. An armrest member is fixed on the upper side of the jacket and the fixed jacket is fixed on the chair. The jacket has an interior spacing for receiving the vertical part of the support pole. The fixed jacket has an interior spacing for receiving the horizontal part of the support pole. The position of the vertical part of the support pole received within the spacing of the jacket is formed with an oblong orifice receiving the first toothed member which is provided with teeth along one side thereof. The jacket is engaged with an elastic button. When a user wants to adjust the arm support to set the height of the chair armrest, the user may press the elastic button, which allows the user to raise or lower the jacket with respect to the support pole so as to adjust the height of the chair armrest. The position of the horizontal part of the support pole received within the spacing of the fixed jacket is also formed with an oblong orifice receiving the second toothed member provided with teeth along one side thereof. The fixed jacket is engaged with an expanded end member. When a user wants to adjust the distance between the chair armrests, the user may rotate the expanded end member so as to adjust the position of the support pole relative to the chair and thus the distance between the chair armrests.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
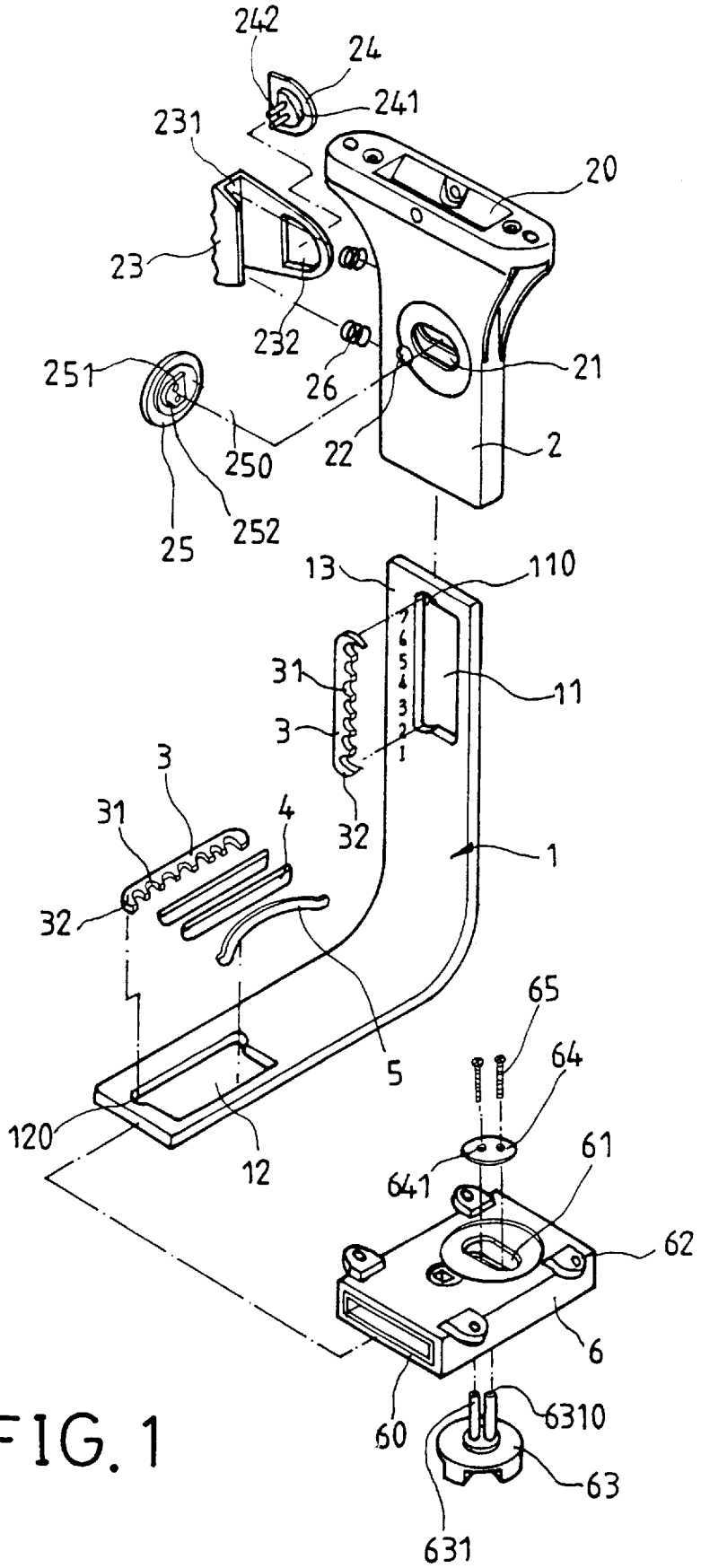
FIG. 1 is an exploded perspective view showing an arm support constructed in accordance with the present invention.

With reference to the drawings and in particular to FIG. 1, wherein an adjustable arm support constructed in accordance with the present invention is shown, the arm support comprises a support pole 1, a jacket 2, an elastic button 23, a first locking plate 24, a second locking plate 25, a fixed jacket 6, an expanded end member 63, a locking cover 64, two toothed members 3, a plurality of strips 4 and resilient members 26 and 5. The support pole 1 which is made of a stiff material is an L-shape. The L-shaped support pole 1 has a vertical part and a horizontal part which are formed respectively with an oblong orifice 11 and 12. The support pole 1 is provided with markings, such as digits 13, next to the oblong orifice 11 of the vertical part. Each end of one of two opposite sides of each oblong orifice 11 or 12 is formed with a concave 110 or 120. Each end of each toothed member 3 is formed with a convex 32 engaged with and retained in the respective concave recess 110 or 120. Each toothed member 3 is provided with teeth 31 along one side thereof.

Figure 2:
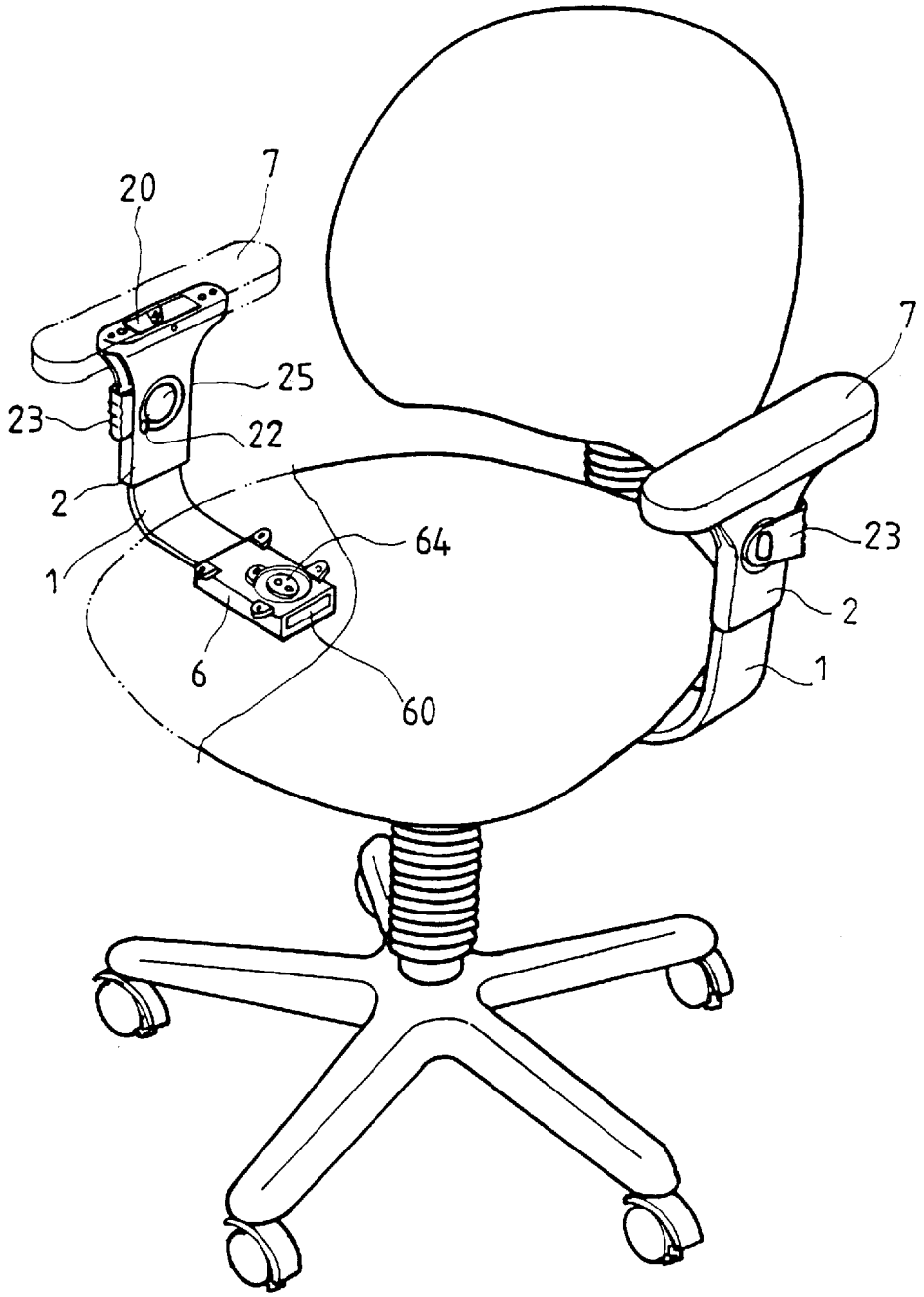
FIG. 2 is a perspective view showing a chair into which the arm support in accordance with the present invention is incorporated.

An armrest member 7 is fixed on the upper side of the jacket 2 as shown in FIG. 2. The jacket 2 has an interior spacing 20 for receiving the vertical part of the support pole 1 therein. The jacket 2 is formed with an elliptical orifice 21 and a circular orifice 22. The elliptical orifice 21 shows the teeth 31 of the first toothed member 3 retained in the oblong orifice 11 of the vertical part of the support pole 1. The circular orifice 22 shows one of the digits 13 provided on the support pole 1 for indicating of relative position of the jacket 2 with respect to the support pole 1.

The elastic button 23 is a U shape having a channel 231 defined by two sides. The channel 231 is sized to receive the width of one side of the jacket 2. One of the two sides of the elastic button 23 is longer and formed with a semi-circular orifice 232 corresponding to the elliptical orifice 21 of the jacket 2. The channel 231 is engaged with the side of the jacket 2 with the resilient members 26 interposed therebetween.

The first locking plate 24 is provided with two locking poles 242 engageable with two of the teeth 31 of the first toothed member 3 fixed inside the oblong orifice 11 of the vertical part of the support pole 1 and a slab 241. A given thickness may be provided between the first locking plate 24 and the locking poles 242. The second locking plate 25 is formed with a cavity 250 having two bores 251 and an overhead piece 252 which extends above the cavity 250 to define a distance therebetween. The bores 251 have an inner diameter smaller than the outer diameter of the locking poles 242 of the first locking plate 24. The distance between the overhead piece 252 and the inner side of the cavity 250 is substantially equal to the thickness of the slab 241 of the first locking plate 24. The locking poles 242 of the first locking plate 24 are received within the bores 251 of the second locking plate 25 by extending through the semi-circular orifice 232 of the elastic button 23, the elliptical orifice 21 of the jacket 2 and the spacing between the teeth 31 of the first toothed member 3, and the slab 241 of the first locking plate 24 is inserted into the distance between the inner side of the cavity 250 and the overhead piece 252 of the second locking plate 25 to have the first locking plate 24 fixed securely on the second locking plate 25.

The fixed jacket 6 is provided with four mounting strap and each mounting strap is formed with a mounting slot 62. The fixed jacket 6 is fixed on the chair by means of any suitable fasteners. The fixed jacket 6 has an interior spacing 60 for receiving the horizontal part of the support pole 1. The fixed jacket 6 is formed with an elliptical orifice 61. The second toothed member 3 that is associated with the oblong orifice 12 of the horizontal part of the support pole 1 is fixed inside the oblong orifice 12 by means of the engagement between the convex 32 of the toothed member 3 and the concave recess 120 of the oblong orifice 12. A plurality of strips 4 are received within the oblong orifice 12, extending in a direction parallel with the second toothed member 3 and are biased by a resilient member 5 to be in contact engagement with the teeth 31 of the second toothed member 3. The resilient member 5 is preferably a bowed shape. The horizontal part of the support pole 1 is received within the spacing 60 of the fixed jacket 6 so that the elliptical orifice 61 of the fixed jacket 6 shows the teeth 31 of the second external teething 3 fixed inside the oblong orifice 12 of the horizontal part of the support pole 1. The expanded end member 63 is provided with two locking poles 631 engageable with two of the teeth 31 of the second toothed member 3. Each locking pole 631 is formed with an inner-threaded hole 6310. The locking cover 64 is formed with two bores 641 in alignment with the locking poles 631 of the expanded end 63. The locking poles 631 extend through the elliptical orifice 61 of the fixed jacket 6 and the spacing between the teeth 31 of the second toothed member 3 to be received within the bores 641 of the locking cover 64 and secured thereon by means of screw 65 engaged with the inner-threaded hole 6310 thereof.

Figure 3:
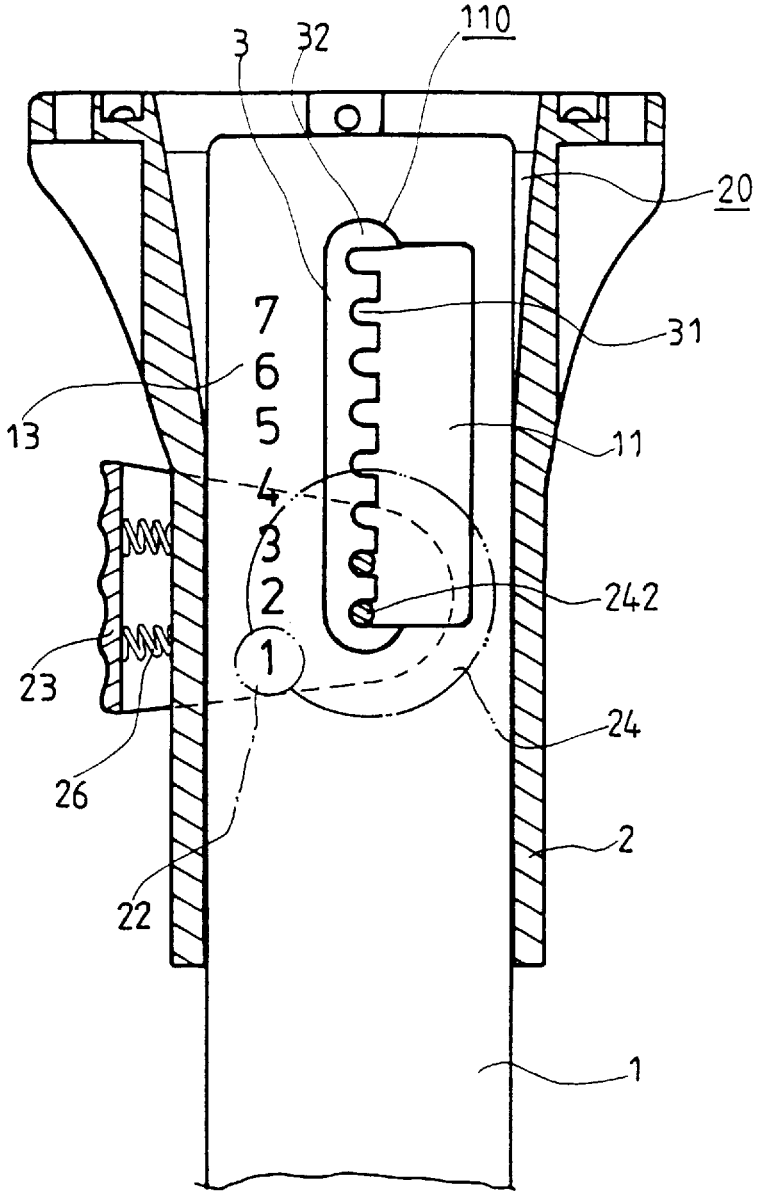
FIG. 3 is a cross-sectional view showing the arm support adjusting to set the height of the chair armrests constructed in accordance with the present invention.
Figure 4:
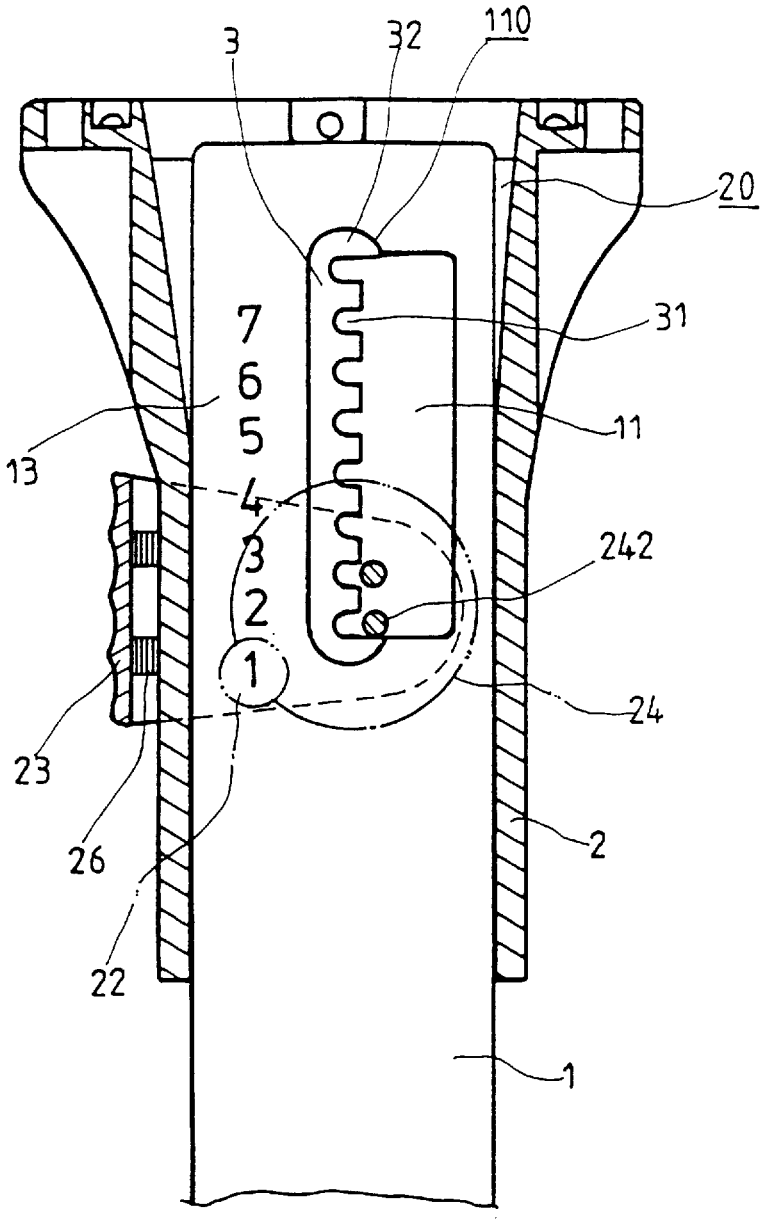
FIG. 4 is a cross-sectional view of the arm support of the present invention showing the locking poles, disengaged from the teeth of the toothed member fixed in the oblong orifice of the vertical part of the support pole when the elastic button is pressed in accordance with the FIG. 3.
Figure 5:
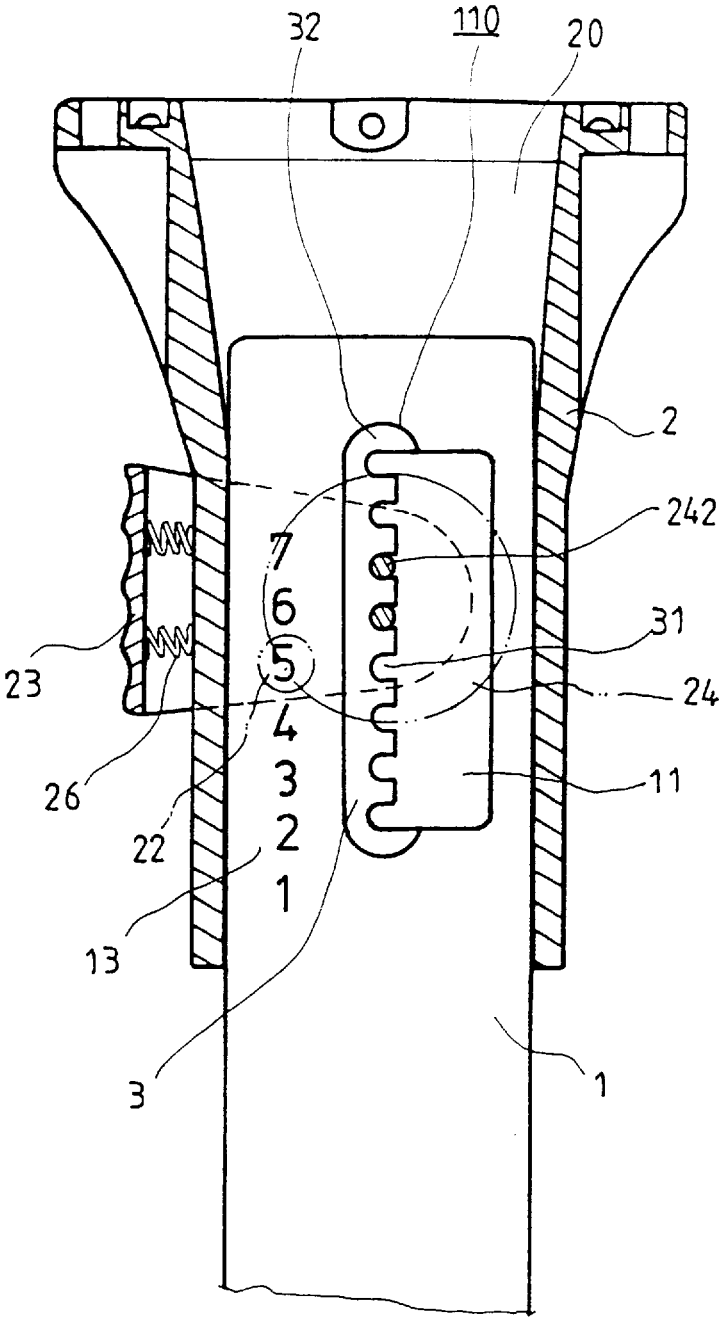
FIG. 5 is a cross-sectional view of the arm support of the present invention showing the jacket raised in accordance with the FIG. 4.

With reference to FIGS. 3, 4 and 5, when a user wants to adjust the arm support to set the height of the chair armrest, the user may press the elastic button 23 to disengage the locking poles 242 from the teeth 31 of the first toothed member 3, this allows the user to raise or lower down the jacket 2 with respect to the support pole 1 so as to adjust the height of the chair armrest. Once the adjustment is completed, by releasing the elastic button 23, the elasticity of the elastic button 23 returns itself to the original position and the locking poles 242 engage the teeth 31 of the first toothed member 3 again to support the jacket 2 at the new position relative to the support pole 1.

Figure 6:
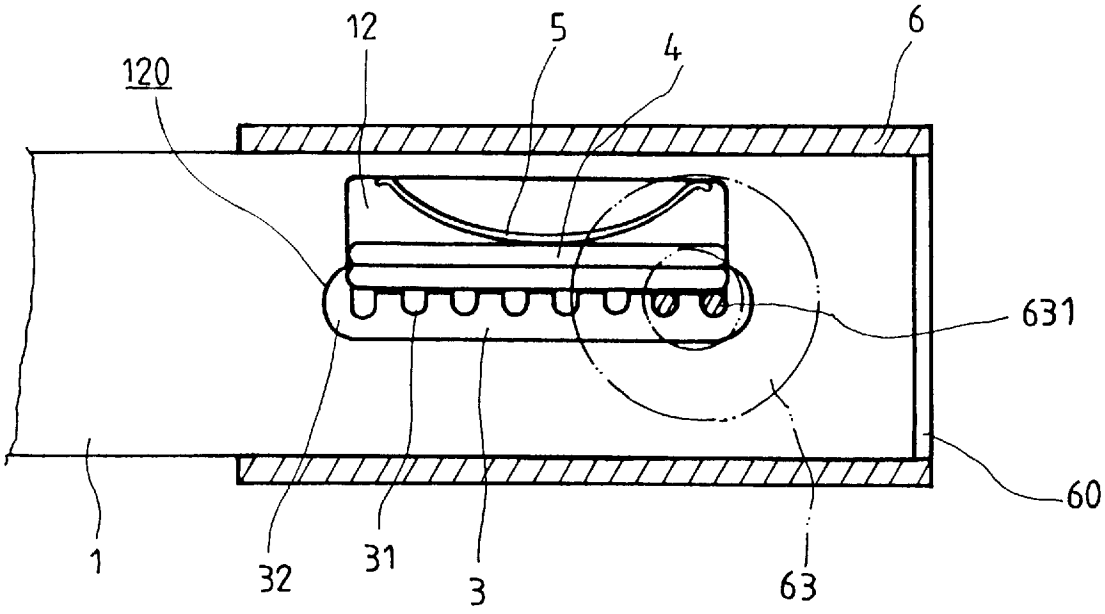
FIG. 6 is a cross-sectional view showing the arm support adjusted to set the distance between the chair armrests constructed in accordance with the present invention.
Figure 7:
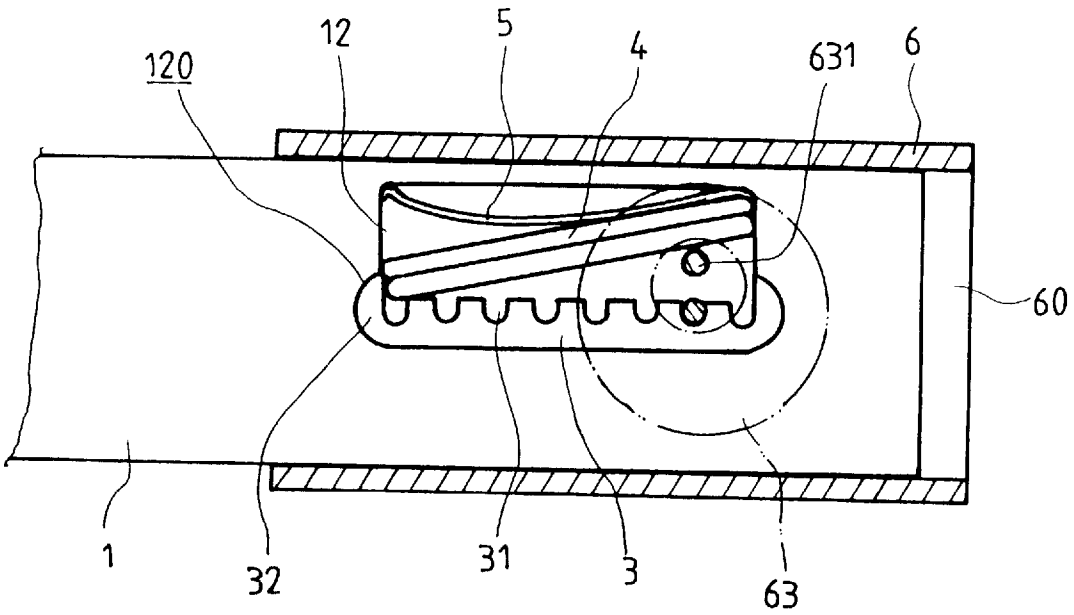
FIG. 7 is a cross-sectional view of the arm support of the present invention showing the support pole moved horizontally when the expanded end member is rotated 90 degrees in accordance with the FIG. 6.
Figure 8:
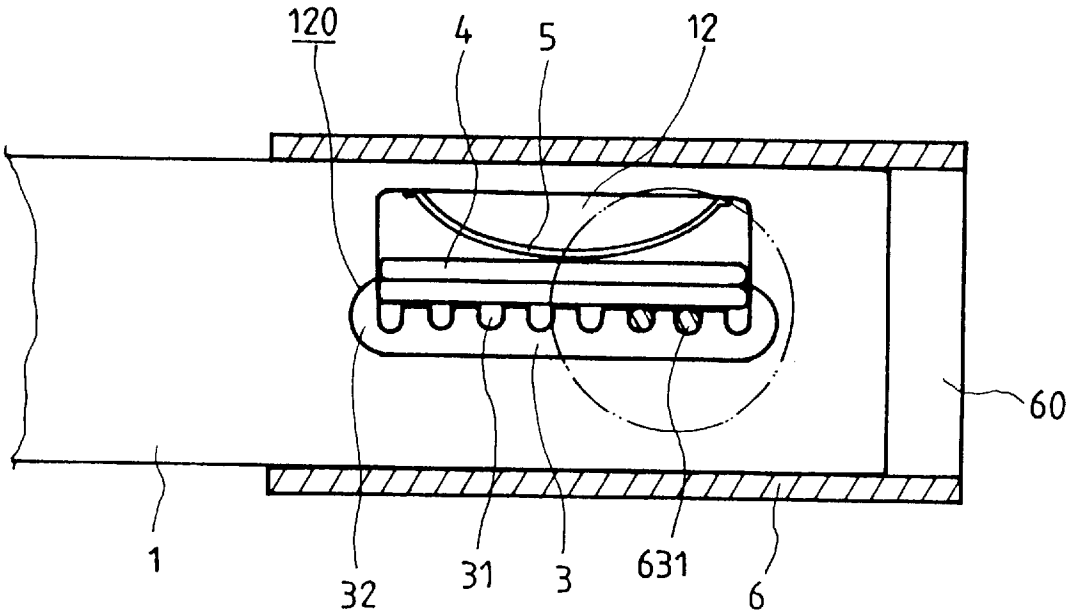
FIG. 8 is a cross-sectional view of the arm support of the present invention showing the support pole moved horizontally when the expanded end rotated again 90 degrees in accordance with the FIG. 7.

With reference to FIGS. 6, 7 and 8, when a user wants to adjust the arm support to set the distance between the chair armrests, the user may rotate the expanded end member 63 against the resilient member 5 to disengage one of the locking poles 631 from the teeth 31 of the second toothed member 3,as shown in FIG. 7. Further rotating the expanded end member 63 allows the locking pole 631 that disengages from the second toothed member 3 to orbit about the other locking pole 631 to get into engagement with next teething 31 of the second toothed member 3 so as to adjust the position of the support pole 1 relative to, the chair and thus the distance between the chair armrests.

Although a preferred embodiment has been described to illustrate the present invention, it is apparent that changes and modifications in the specifically described embodiment can be carried out without departing from the scope of the invention which is intended to be limited only by the appended claims.

What is claimed is:

1. An arm support which is adjustable to set a height of a chair armrest and a distance between a pair of the armrest on a chair, said arm support comprising:

an L-shaped support pole having a vertical part and a horizontal part, said vertical part having a plurality of digits next to a first oblong orifice with a concave recess on each end thereof;

a first toothed member having spaced teeth along one side and a convex projection on each end thereof engaged respectively in each concave recess of said first oblong orifice;

a jacket formed with an elliptical orifice and a circular orifice and having an interior spacing for receiving the vertical part, the elliptical orifice showing the teeth of the first toothed member fixed inside the first oblong orifice and the circular orifice showing one of the digits on the vertical part;

a U-shaped elastic button having a channel defined by two sides to receive a width of one side of the jacket and engage said one side with a plurality of resilient members interposed between the button and the one side of the jacket, one side of the elastic button being longer and formed with a semi-circular orifice corresponding to the elliptical orifice of the jacket;

a first locking plate provided with two locking poles engaged between the teeth of the first toothed member fixed inside the first oblong orifice and a slab having a given thickness between the first plate and the locking poles;

a second locking plate formed with a cavity having two bores having an inner diameter smaller than the outer diameter of the locking poles of the first locking plate and an overhead piece extending above the cavity to define a distance therebetween which is substantially equal to the thickness of the slab of the first locking plate, and receiving securely the first locking plate by engaging the locking poles of the first locking plate within the bores of the second locking plate when extended through the semi-circular orifice of the elastic button, the elliptical orifice of the jacket and spacing between teeth of the first toothed member and the slab of the first locking plate inserted into the distance between the inner side of the cavity and overhead piece;

means on said, horizontal part for adjusting a distance between a pair of the chair armrest on the chair;

wherein, when the elastic button is pressed from a normal position to disengage the locking poles of the first locking plate from the teeth of the first toothed member, the jacket can be raised or lowered with respect to the vertical part so as to adjust the height of the chair armrest, wherein, after the adjustment is complete the elastic button is released and the elasticity of the elastic button returns to the normal position, the locking poles engage teeth of the first toothed member and then support the jacket at a new position relative to the vertical part.

2. The arm support according to claim 1, wherein said means on said horizontal part for adjusting a distance between a pair of the chair armrest comprises:

said horizontal part having a second oblong orifice with a concave recess on each end thereof, a second toothed member having spaced teeth along one side and a convex projection on each end thereof engaged respectively in each concave recess of said second oblong orifice;

a plurality of strips received within the second oblong orifice, extending in a direction parallel with the second toothed member and biased by a resilient member which is a bowed shape to be in contact engagement with the teeth of the second toothed member, a fixed jacket fixed on the chair, formed with an elliptical orifice and having an interior spacing for receiving the horizontal part of the support pole, the elliptical orifice showing the teeth of the second toothed member fixed inside the second oblong orifice, an expanded end member provided with two locking poles between the teeth of the second toothed member and formed respectively with an inner-threaded hole;

a locking cover formed with two bores receiving the locking poles of the expanded end member by means of the locking poles of the expanded end member expanding through the oblong orifice of the fixed jacket and spacing between teeth of the second toothed member; and two screws engaged with the inner-threaded holes of the locking poles of the expanded end member received within the bores of the locking cover;

wherein rotation of the expanded end member against the resilient member disengages the locking poles of the expanded end member from the teeth of the second toothed member, and further rotation of the expanded end member permits a first locking pole of the locking poles that disengages from the toothed member to orbit about a second locking pole of the locking poles to engage between the next teeth of the second toothed member so as to adjust the position of the support pole relative to the chair and thus the distance between the pair of chair armrests.

* * * * *